United States Patent [19]

Chelin

[11] 4,010,825

[45] Mar. 8, 1977

[54] LIFT CHAIN EQUALIZING DEVICE

[75] Inventor: Charles R. Chelin, Dallas, Oreg.

[73] Assignee: Towmotor Corporation, Mentor, Ohio

[22] Filed: Apr. 5, 1976

[21] Appl. No.: 674,028

[52] U.S. Cl. ..... 187/9 R; 187/1 A

[51] Int. Cl.[2] ..... B66B 9/20; B66F 9/06

[58] Field of Search ..... 187/1 A, 9 R, 9 E; 214/730, 660, 670–674

[56] References Cited

UNITED STATES PATENTS

| | | | |
|---|---|---|---|
| 2,089,143 | 8/1937 | White | 187/1 A |
| 3,213,967 | 10/1965 | Hastings et al. | 187/9 E |

FOREIGN PATENTS OR APPLICATIONS

| | | | |
|---|---|---|---|
| 777,297 | 6/1957 | United Kingdom | 187/1 A |

*Primary Examiner*—Johnny D. Cherry
*Assistant Examiner*—Jeffrey V. Nase
*Attorney, Agent, or Firm*—Frank L. Hart

[57] ABSTRACT

A material handling vehicle has a generally vertically movable carriage, first and second spaced apart, chain assemblies connected to the carriage, and a power device associated with the chain assemblies for generally vertically moving the first ends of the chain assemblies and the carriage in response thereto. A pivot element is associated with the chain assemblies for controlling relative movement thereof.

7 Claims, 3 Drawing Figures

LIFT CHAIN EQUALIZING DEVICE

BACKGROUND OF THE INVENTION

In the use of material handling vehicles, such as lift trucks, first and second chain assemblies are moved by a power means and function to elevate and lower the carriage. Under various conditions, such as uneven loading of the carriage, uneven ground or substrate upon which the vehicle is resting, and others, the force subjected on one of the chain assemblies is often considerably greater than the force on the other chain assembly. This unevenness of forces places considerable stresses on associated elements of the vehicle which sometimes damages the vehicle and/or causes an increased wear rate which represents waste.

This invention therefore resides in means for controlling relative forces on the chains.

DETAILED DESCRIPTION OF THE INVENTION

Figure 1:
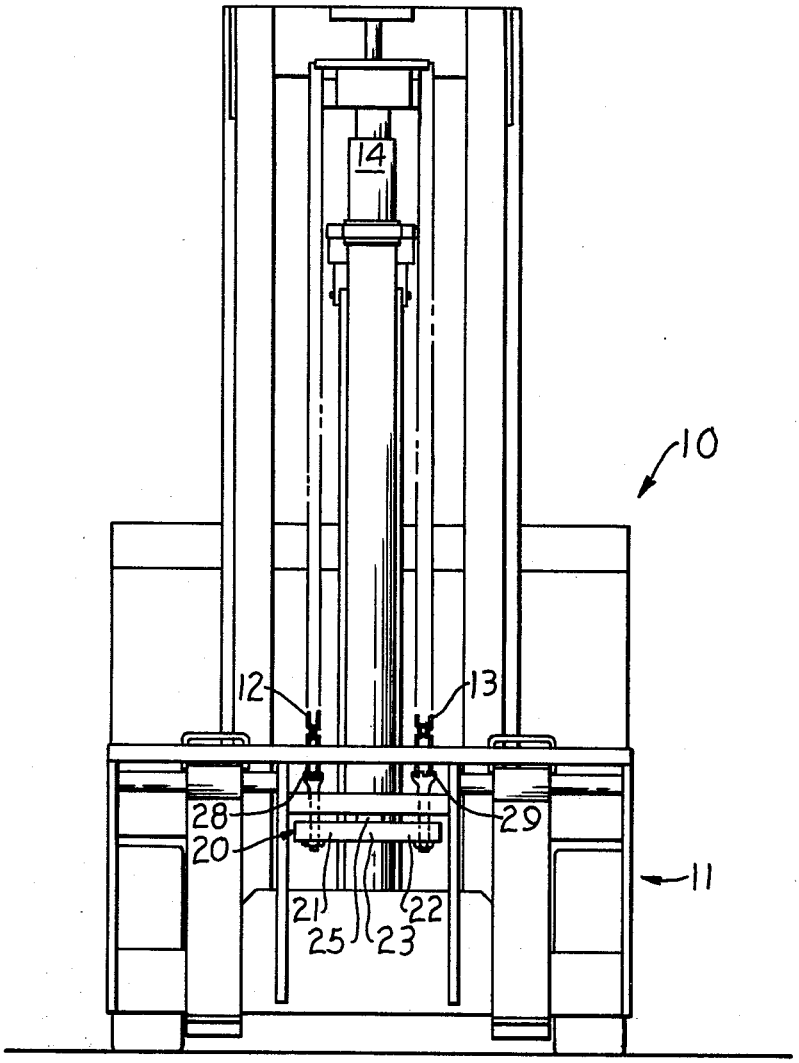
FIG. 1 is a diagrammatic view in elevation of a vehicle having the apparatus of this invention.

Referring to FIG. 1, a material handling vehicle 10, such as a lift truck for example, has a generally vertically movable carriage 11, first and second spaced apart chain assemblies 12,13, and power means 14, for example a hydraulic cylinder, associated with the chain assemblies 12,13. The first ends 28,29 of the chain assemblies 12,13 are connected to the carriage 11, the second ends (not shown) of the chain assemblies are anchored to a fixed or stationary member of the vehicle 10 and said first ends are controllably generally vertically movable by the power means 14 for moving the carriage 11 in response thereto, as is known in the art.

A pivot element 20 is provided for connecting the chain assemblies 12,13 to the carriage 11. The pivot element 20 has first and second end portions 21,22 and a middle portion 23. The first chain assembly 12 is connected to the first end portion 21 of the pivot element 20 and the second chain assembly 13 is connected to the second end portion 22 of the pivot element 20.

The pivot element 20 is maintained against following the chain assemblies 12,13 by a fulcrum member 25 positioned in contact with and at a higher elevation than the pivot element 20.

Figure 2:
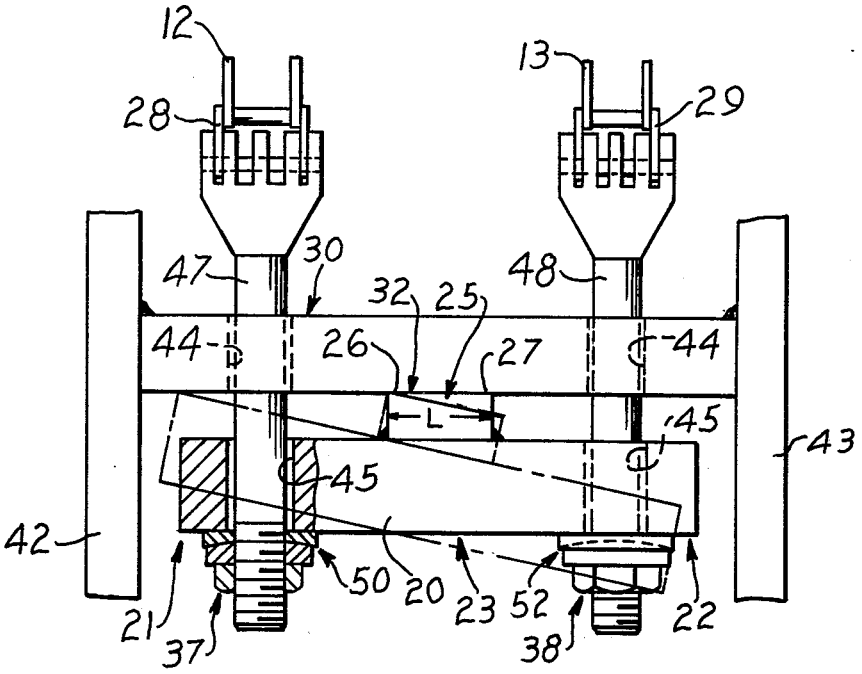
FIG. 2 is a diagrammatic enlarged frontal view of the apparatus of this invention.

Referring to FIG. 2, the fulcrum member 25 has first and second space apart pivot areas 26,27 in contact with the middle portion 23 of the pivot element 20 at locations substantially equally spaced between the first ends 28,29 of the chain assemblies 12,13.

Figure 3:
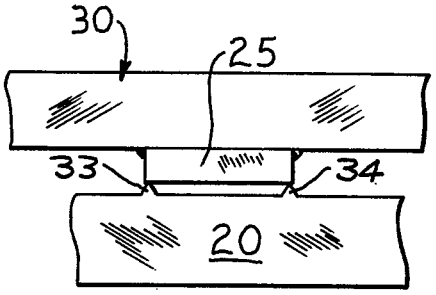
FIG. 3 is a diagrammatic view of another embodiment of the apparatus of this invention.

The fulcrum member 25 can be fixedly connected to a portion of the carriage 11, as shown in FIG. 3, or can be a portion of the pivot element 20, as shown in FIG. 2. The assembly includes a stop 30 positioned at a higher elevation than the fulcrum member 25. It should also be understood that the pivot areas 26,27 can be on separate elements without departing from this invention.

In the embodiment of FIG. 2, the fulcrum member 25 is connected to the pivot element 20, has a length L extending a preselected distance along the pivot element 20 and a planar face 32 in contact with the stop member 30.

During pivoting of the pivot element 20, as shown by broken lines, edges of the fulcrum member 25 become the first and second pivot areas 26,27, which edge depends upon which direction the pivot element 20 is pivoted.

In the embodiment of FIG. 3, the pivot areas are defined by first and second spaced apart protrusions 33, 34 extending from the pivot element 20 and about which the element 20 pivots.

Bolt and nut assembly means 37,38 or other control means can be used for connecting the first ends 28,29 of the chain assemblies 12,13 to the pivot element 20 for controllably moving the pivot element 20 relative to the first ends 28,29 of each chain assembly 12,13 for controllably adjusting or "fine tuning" the forces on the pivot element 20.

Referring to FIG. 2, stop means 30 is provided for limiting the pivotal movement of each end of the pivot element 20 to preselected values. First and second restraining means 42,43 can be provided for limiting the lateral movement of the pivot element 20 to preselected values.

The stop means 30 is a portion of the carriage 11 and can include the connection assembly of the chain assemblies 12,13. Where the chain connecting assemblies are a portion of the movement stopping system of the pivot element 20, adjacent openings 44,45 are formed in the end portions 21, 22 of the pivot element 20 and the stop means 30 of the carriage 11. First and second holding means 47,48 are connected to their respective chain assembly 12,13 and pass through the adjacent respective openings 44,45. Each of the openings 44,45 and associated holding means 47,48 are sized relative one to the other for limiting lateral movement of the pivot element 20 to a preselected value.

The first and second restraining means 42,43 can be a portion of the carriage 11, such as generally vertically extending members each positioned a preselected distance from a respective end of the pivot element 20.

By so constructing the apparatus of this invention, excessive loads on one of the chain assemblies, for example chain assembly 12, or the breaking of chain assembly 13 causes the first end portion 21 of the pivot element 20 to move toward the stop means 30. The length L of the fulcrum member 25 causes a change in the moment arm owing to the spaced positions of the pivot areas 26,27. The second end portion 22 moves a greater distance than the first end portion 21 thereby causing a greater shifting of the load to the second chain assembly 13 than if a single pivot area were used. The equalization of the load between the chain assemblies 12,13 is therefore of improved efficiency.

The stop means 30 functions to limit the movement of the pivot element 20 and thereby reduces the sudden strain on the first chain assembly 12 where, for example, the second chain assembly 13 breaks. The balance effect of the invention can also be "fine tuned" by the control means 37,38 as described above.

In the preferred embodiment of FIG. 2, ball seat washer assemblies 50,52 are positioned between the respective nuts 37,38 and the pivot element 20 for uniformly loading the nuts 37,38 at canted positions of the first element 20.

Other aspects, objects, and advantages of this invention can be obtained from a study of the drawings, the disclosure, and the appended claims.

What is claimed is:

1. In a material handling apparatus having a generally vertically movable carriage, first and second spaced apart chain assemblies each connected at their first ends to the carriage, and power means associated with the chain assemblies for generally vertically moving the first ends of the chain assemblies and the carriage in response thereto, the improvement comprising:

a pivot element having first and second end portions and a middle portion and being connected at the first and second end portions to the first ends of respective chain assemblies;

a fulcrum member having first and second spaced apart pivot areas positioned at locations substantially equally spaced from the first ends of the chain assemblies with said fulcrum member being at a higher elevation than said pivot element; and stop means for limiting vertical and pivotal movements of the pivot element to preselected values.

2. Apparatus, as set forth in claim 1, including first and second restraining means for limiting lateral movement of the pivot element to preselected values.

3. Apparatus, as set forth in claim 2, wherein the first and second restraining means each comprise generally vertically extending members each connected to the carriage and positioned a preselected distance from a respective end of the pivot element.

4. Apparatus, as set forth in claim 3, wherein the stop means includes adjacent openings formed in the first and second end portions of the pivot element and the carriage and first and second holding means being connected to a respective chain assembly and passing through the adjacent respective openings, each of said adjacent openings and associated holding means being sized relative one to the other for limiting lateral movement of the pivot element.

5. Apparatus, as set forth in claim 1, wherein the fulcrum member is fixedly connected to the pivot element.

6. Apparatus, as set forth in claim 5, wherein the fulcrum member has a length L extending a preselected distance along the pivot element and a planar face in contact with the stop means.

7. Apparatus, as set forth in claim 1, wherein the pivot areas are defined by first and second protrusions extending from the pivot element.

* * * * *